US009490095B2

(12) United States Patent
Matsumoto

(10) Patent No.: US 9,490,095 B2
(45) Date of Patent: Nov. 8, 2016

(54) FUSIBLE LINK UNIT

(75) Inventor: Yusuke Matsumoto, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 239 days.

(21) Appl. No.: 13/521,297

(22) PCT Filed: Jan. 11, 2011

(86) PCT No.: PCT/JP2011/050288
§ 371 (c)(1),
(2), (4) Date: Jul. 10, 2012

(87) PCT Pub. No.: WO2011/086995
PCT Pub. Date: Jul. 21, 2011

(65) Prior Publication Data

US 2012/0286922 A1 Nov. 15, 2012

(30) Foreign Application Priority Data

Jan. 12, 2010 (JP) ..... 2010-003590

(51) Int. Cl.

| | |
|---|---|
| ***H01H 85/30*** | (2006.01) |
| ***H01H 85/175*** | (2006.01) |
| ***H01H 85/00*** | (2006.01) |
| *H01H 85/165* | (2006.01) |
| *H01H 85/02* | (2006.01) |
| *H01H 85/055* | (2006.01) |

(52) U.S. Cl.
CPC ..... *H01H 85/175* (2013.01); *H01H 85/0078* (2013.01); *H01H 85/165* (2013.01); *H01H 2085/025* (2013.01); *H01H 2085/0555* (2013.01)

(58) Field of Classification Search
CPC ..... H01H 85/0078; H01H 85/175; H01H 85/165; H01H 2085/0555; H01H 2085/025
USPC ..... 337/206, 186, 227
See application file for complete search history.

(56) References Cited

U.S. PATENT DOCUMENTS

| | | | | |
|---|---|---|---|---|
| 4,800,358 | A * | 1/1989 | Takenouchi et al. | 337/268 |
| 4,808,962 | A * | 2/1989 | Ikeda | 337/203 |
| 5,531,345 | A * | 7/1996 | Nakamura et al. | 220/3.8 |
| 5,825,274 | A * | 10/1998 | Totsuka | 337/190 |
| 6,294,978 | B1 * | 9/2001 | Endo et al. | 337/166 |

(Continued)

FOREIGN PATENT DOCUMENTS

| | | |
|---|---|---|
| CN | 101553964 A | 10/2009 |
| DE | 10-2008-053485 A1 | 5/2009 |

(Continued)

OTHER PUBLICATIONS

International Search Report for PCT/JP2011/050288 dated Feb. 8, 2011 [PCT/ISA/210].

(Continued)

*Primary Examiner* — Anatoly Vortman
(74) *Attorney, Agent, or Firm* — Sughrue Mion, PLLC

(57) ABSTRACT

A fusible link unit includes a conductive busbar, a resin housing, and a resin cover. The conductive busbar includes a fusible part. The resin housing is integrally formed at a predetermined position of the busbar. The resin cover is locked so as to cover an exposure window of the resin housing which is formed so that the fusible part is observed. The resin housing has an integral wall at the back position of the exposure window which faces the fusible part.

2 Claims, 7 Drawing Sheets

(56) References Cited

U.S. PATENT DOCUMENTS

| | | | | |
|---|---|---|---|---|
| 6,448,882 | B1 * | 9/2002 | Inaba et al. | 337/227 |
| 6,509,824 | B2 * | 1/2003 | Inaba et al. | 337/295 |
| 6,512,443 | B1 * | 1/2003 | Matsumura et al. | 337/189 |
| 6,746,279 | B1 | 6/2004 | Lopez | |
| 6,806,421 | B2 * | 10/2004 | Matsumura | 174/50 |
| 7,176,780 | B2 * | 2/2007 | Iwata | 337/188 |
| 7,420,453 | B2 * | 9/2008 | Matsumura et al. | 337/295 |
| 7,637,781 | B2 * | 12/2009 | Matsumoto et al. | 439/620.27 |
| 7,663,465 | B2 * | 2/2010 | Matsumoto et al. | 337/187 |
| 7,802,998 | B2 * | 9/2010 | Taguchi et al. | 439/76.2 |
| 8,721,367 | B2 * | 5/2014 | Matsumoto et al. | 439/620.26 |
| 2001/0011939 | A1 | 8/2001 | Inaba et al. | |
| 2002/0163416 | A1 * | 11/2002 | Matsumura | 337/112 |
| 2004/0070485 | A1 * | 4/2004 | Andoh et al. | 337/198 |
| 2005/0116805 | A1 | 6/2005 | Taga et al. | |
| 2009/0108982 | A1 | 4/2009 | Ohashi et al. | |
| 2009/0251200 | A1 | 10/2009 | Urrea et al. | |
| 2010/0008023 | A1 | 1/2010 | Hirschfeld | |
| 2012/0020036 | A1 * | 1/2012 | Matsumoto | 361/752 |

FOREIGN PATENT DOCUMENTS

| | | | |
|---|---|---|---|
| GB | 1363905 | A | 8/1974 |
| JP | 2000-30600 | A | 1/2000 |
| JP | 2001-297683 | A | 10/2001 |
| JP | 2002-358866 | A | 12/2002 |
| JP | 2006-236693 | A | 9/2006 |
| JP | 2007-80709 | A | 3/2007 |
| JP | 2007-179978 | A | 7/2007 |

OTHER PUBLICATIONS

Written Opinion for PCT/JP2011/050288 dated Feb. 8, 2011 [PCT/ISA/237].

English Translation of Written Opinion, dated Feb. 8, 2011, issued by the International Searching Authority in counterpart International Application No. PCT/JP2011/050288.

Office Action dated Apr. 2, 2014 issued by the State Intellectual Property Office of the People's Republic of China in counterpart Chinese Patent Application No. 201180005721.6.

Office Action, Issued by the State Intellectual Property Office of P.R. China, Dated Nov. 15, 2014, in counterpart Chinese application No. 201180005721.6.

Communication dated May 11, 2015 issued by the State Intellectual Property Office of the People's Republic of China in counterpart Chinese Patent Application No. 201180005721.6.

Office Action dated Dec. 17, 2014 issued by German Patent Office in counterpart German Patent Application No. 112011100232.7.

Office Action, issued on Sep. 11, 2015 by the State Intellectual Property Office of P.R. China in counterpart Chinese Application No. 201180005721.6.

Office Action dated Mar. 25, 2014 issued by the Japanese Patent Office in counterpart Japanese Patent Application No. 2010-003590.

* cited by examiner

FUSIBLE LINK UNIT

This application is based on the Japanese patent application (patent application 2010-003590) filed on Jan. 12, 2010, whose content is incorporated herein by reference

TECHNICAL FIELD

The invention relates to a fusible link unit which has an exposure window which houses fusible parts, and has a resin cover which is fastened and covers the exposure window.

BACKGROUND ART

In FIGS. 7(*a*) and 7(*b*), a fusible link unit 1 (fuse unit 6 of Japan Patent Publication No. 2001-297683; hereinafter "JP '683") is connected to a battery of an automobile and supplies electric power to loads. The fusible link unit 1 includes a conductive busbar 3 (fuse element 1 of JP '683) which has a plurality of fusible parts 2*a*, 2*b* to 2*e* (fusible parts 2 of JP '683), resin housings 4 and 5 (resin bodies 4 and 5 of JP '683) which are integrally formed at predetermined positions of the busbar 3, and transparent resin covers 6 and 7 (covers 26 and 36 of JP '683) which are fastened to the resin housings 4 and 5.

The busbar 3 has a battery terminal connecting portion 8 (power source connecting parts 19 and 32 of JP '683) which is connected to a battery terminal not shown in the figure, and a wire connecting portion 10 (terminal connecting parts 31 and 34 of JP '683) which is provided with a bolt 9 (stud bolt 34 of JP '683) and can be connected to the terminal of an electric wire which is not shown in the figure, and the fusible part 2*a*, all of which are portions that are exposed from the resin housing 4. Further, the busbar 3 has the fusible parts 2*b* to 2*e*, and a plurality of tab terminals 11 which are connected to the loads, both of which are portions that are exposed from the resin housing 5. The busbar 3 has a hinge shown with a reference sign 12 which is another exposed portion. The hinge 12 is formed as a portion where the resin housings 4 and 5 are bent with respect to each other.

The resin housings 4 and 5 have exposure windows 13 and 14 (empty chambers 24 and 35 of JP '683) in order to expose the fusible parts 2*a*-2*e*. The exposure window 13 is formed so that the fusible part 2*a* can be observed from both directions, or from the front and the back of the resin housing 4, and the exposure window 14 is formed so that the fusible parts 2*b* to 2*e* can be observed from both directions, or from the front and the back of the resin housing 5. The exposure windows 13 and 14 are covered with transparent resin covers 6 and 7 from both directions, or from the front and the back of the resin housings 4 and 5. The exposure windows 13 and 14 and the transparent resin covers 6 and 7 are fastened by lock projections and lock parts which are hooked to the lock projections.

SUMMARY OF INVENTION

Technical Problem

The exposure windows 13 and 14 in the above-mentioned prior art are formed so that the fusible parts 2 can be observed from both directions, or from the front and the back of the resin housings 4 and 5. However, when the fusible link unit 1 is assembled to a battery which is not shown in the figure, the fusible parts 2 are not visually recognized from the side which faces the battery, and therefore there is a problem that it is not necessary to use one of the transparent resin covers 6 and 7 (the one shown with the reference sign 7).

The transparent resin covers 6 and 7 in the above-mentioned prior art are formed by using an expensive resin material which is transparent and heat resistant. Thus, there is a problem that the cost of the fusible link unit 1 is increased due to the unnecessary transparent resin cover 7.

In view of the above-mentioned problems, an object of the invention is to provide a fusible link unit which makes it possible to reduce the number of components, to simplify the structure, and to reduce the cost.

Solution to Problem

The above-mentioned object of the invention is achieved by the following structures.

A fusible link unit comprising:

a conductive busbar including a fusible part;

a resin housing which is integrally formed at a predetermined position of the busbar; and a resin cover which is fastened so as to cover an exposure window of the resin housing which is formed so that the fusible part is observed, wherein the resin housing has an integral wall at the back position of the exposure window which faces the fusible part.

In the fusible link unit of the above, the wall is integrated at the back position of the exposure window in the resin housing. When the fusible link unit is assembled to a battery or the like, the wall is arranged at the side where it is not necessary to visually recognize the fusible parts, and the resin cover becomes unnecessary at this side.

In the fusible link unit of the above, the resin cover has lock projections at positions of both sides of a cover body of the resin cover, and the resin housing has slits at positions of the both sides of the resin housing, the slit being produced by the wall and covered by the lock projections.

In the fusible link unit of the above, the opening parts of the slits are used as the portions which are hooked to the lock projections of the resin cover. The slits are portions produced when the wall is formed, i.e., die cutting holes, and thus the portions are also effectively used.

DESCRIPTION OF EMBODIMENTS

Figure 1:
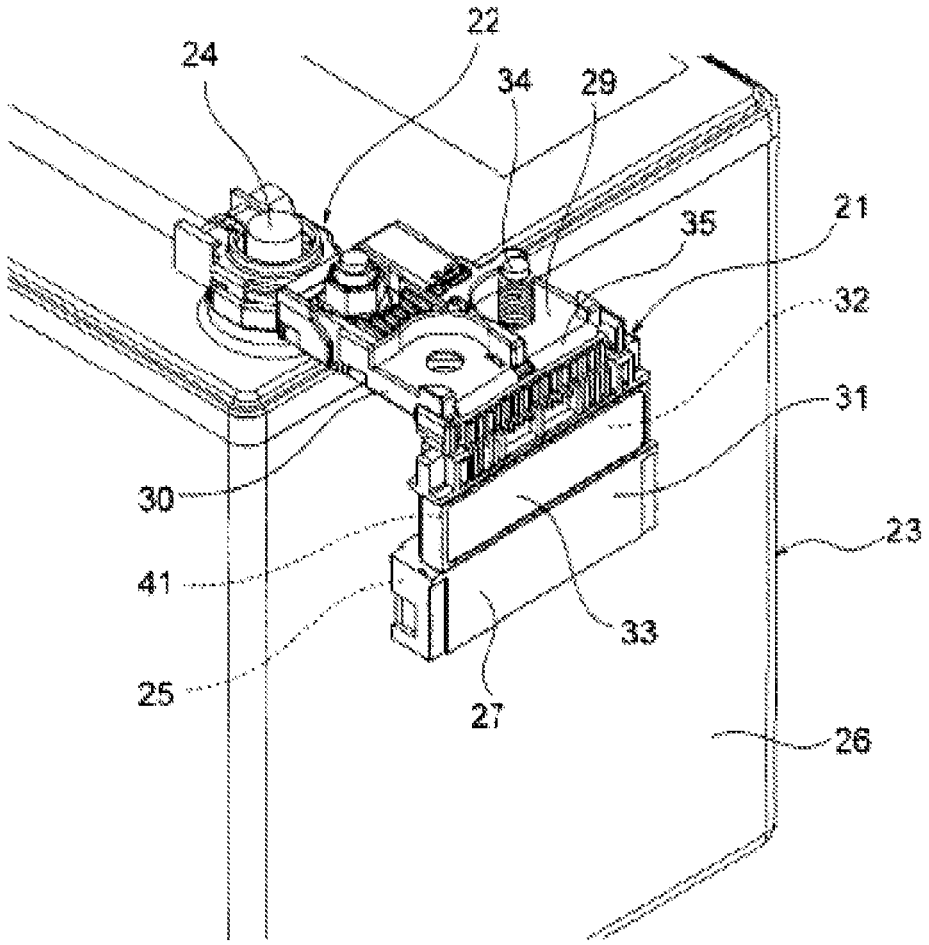
FIG. 1 is a perspective view which shows a state when a fusible link unit according to one embodiment of the invention is assembled to a battery.
Figure 2:
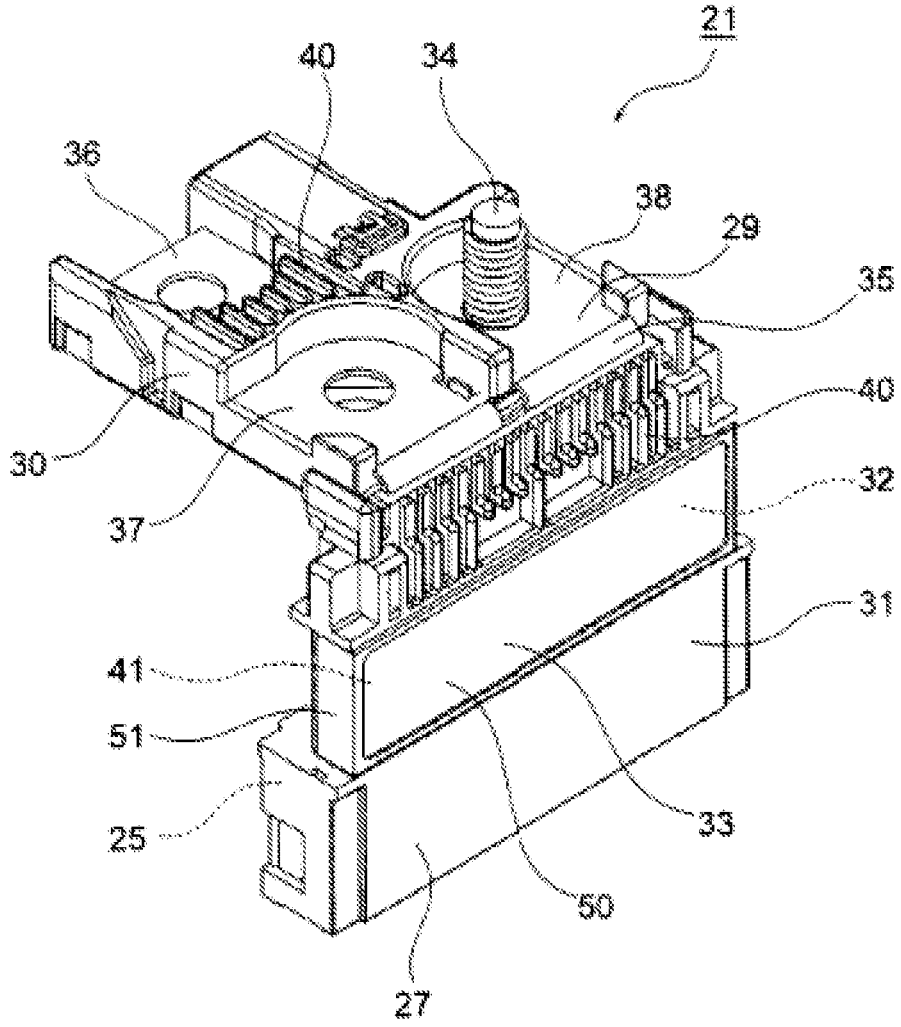
FIG. 2 is a perspective view of the fusible link unit shown in FIG. 1.
Figure 3:
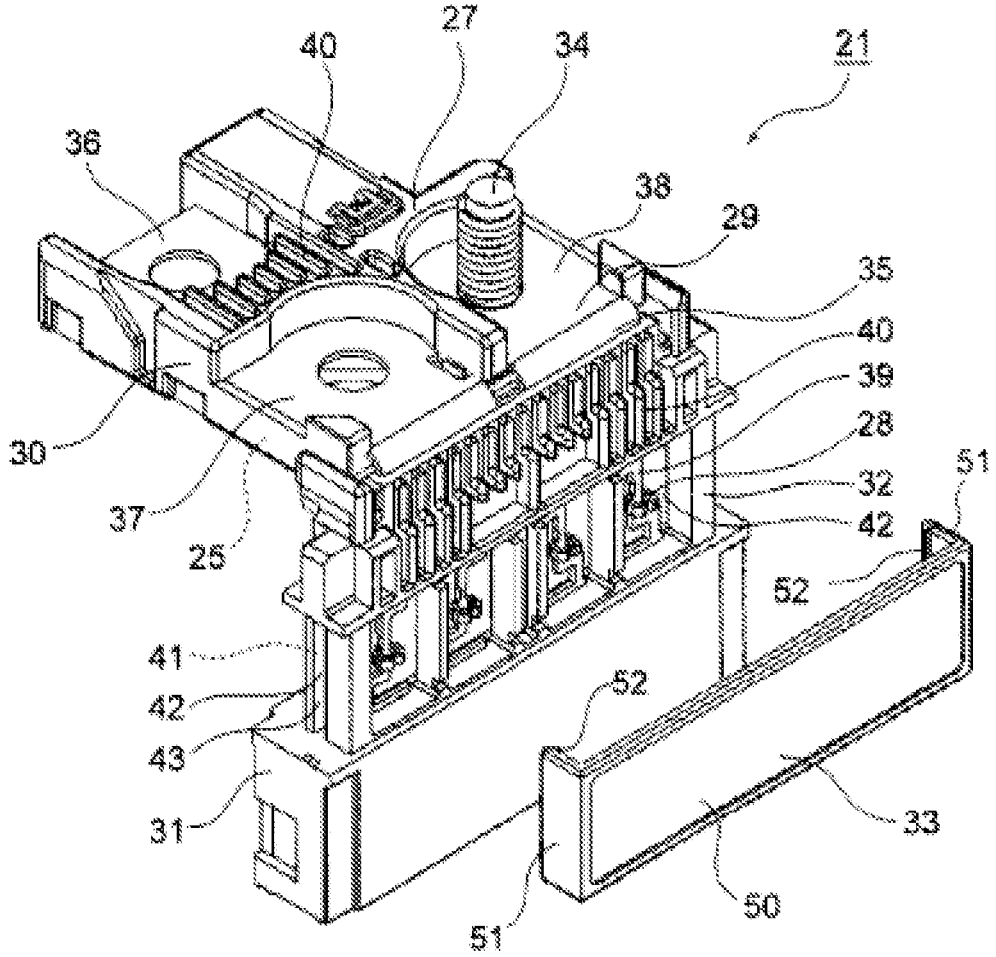
FIG. 3 is an exploded perspective view of the fusible link unit shown in FIG. 1.
Figure 5:
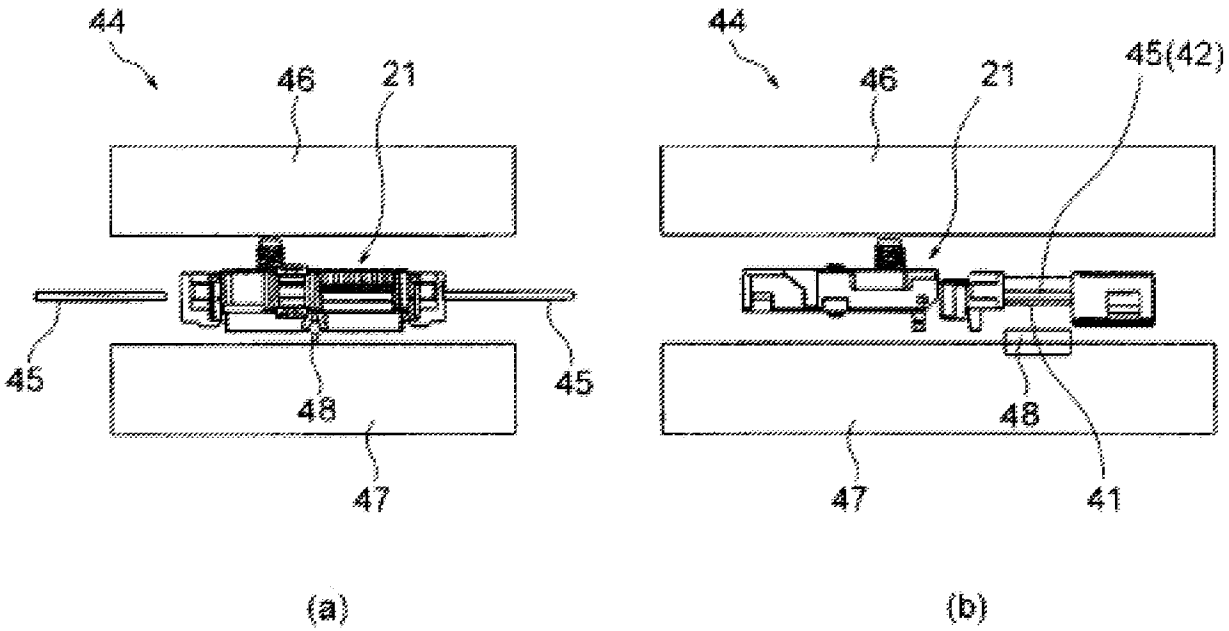
FIG. 5 is a figure of a resin forming metal mold which forms the fusible link unit shown in FIG. 1, in which FIG. 5(*a*) is a top view and FIG. 5(*b*) is a side view.
Figure 6:
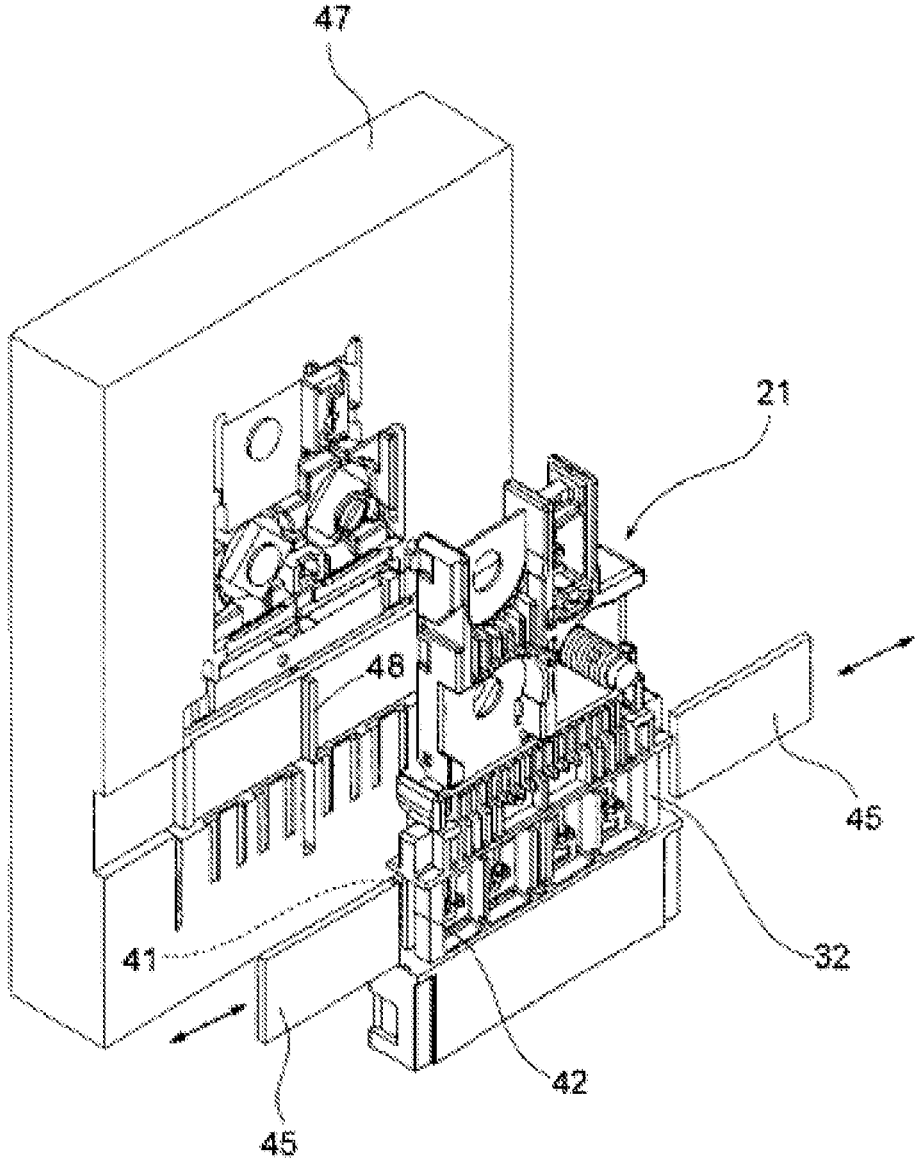
FIG. 6 is a perspective view which shows a lower mold and a slide mold of the resin forming metal mold and the fusible link unit shown in FIG. 5.
Figure 7:
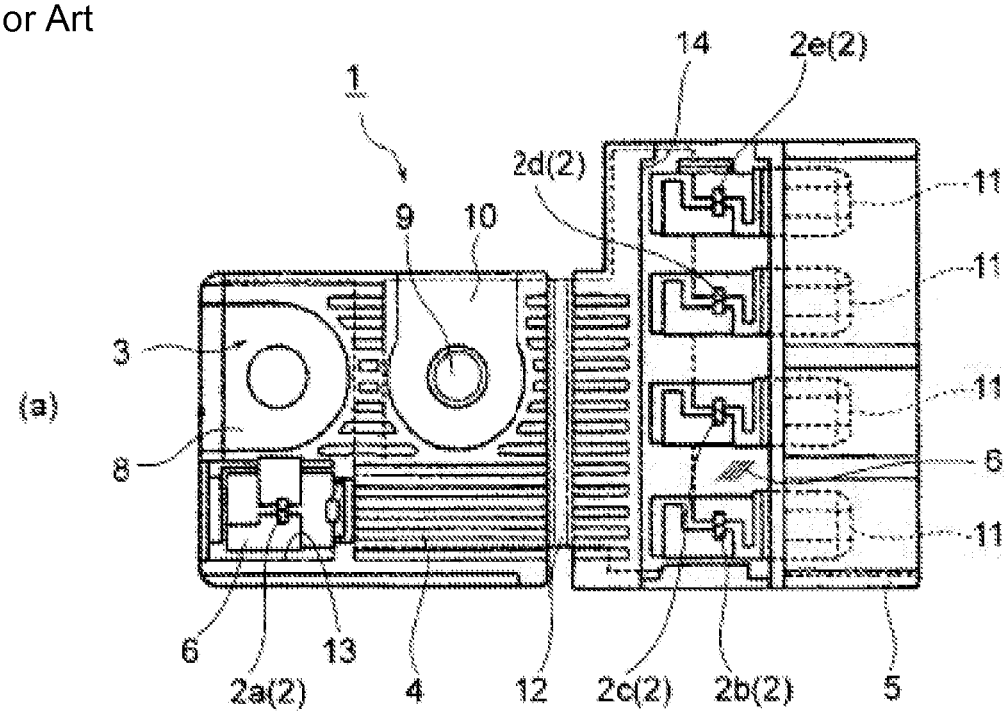
Fig. 7 Prior Art
FIG. 7 is a figure of an example of a conventional fusible link unit, in which FIG. 7(*a*) is a top view and FIG. 7(*b*) is a front view.
Figure 7:
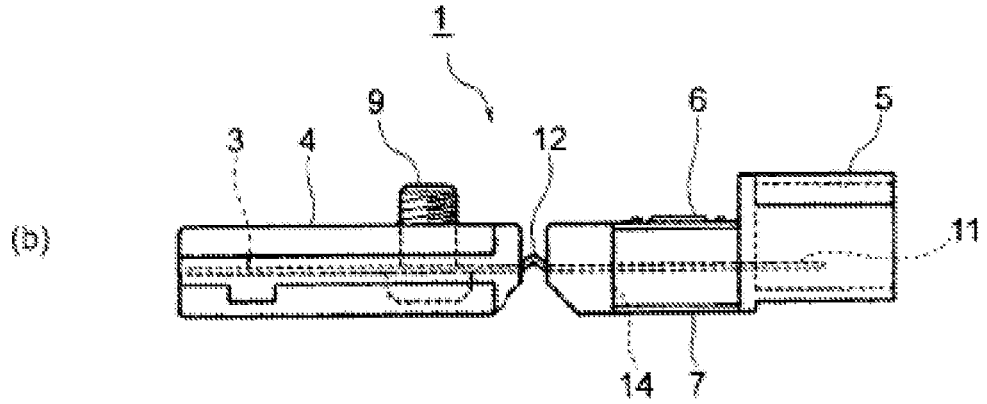
Fig. 7 Prior Art

Below, one embodiment will be described with reference to the figures. FIG. 1 is a perspective view which shows a state when a fusible link unit according to one embodiment of the invention is assembled to a battery. FIG. 2 is a perspective view of the fusible link unit, FIG. 3 is an exploded perspective view of the fusible link unit, and FIGS. 4(*a*) to 4(*d*) are figures which show states before the fusible link unit is bended. FIGS. 5(*a*) and 5(*b*) are figures of a resin forming metal mold which forms the fusible link unit, and FIG. 6 is a perspective view which shows a lower mold and a slide mold of the resin forming metal mold and the fusible link unit.

In FIG. 1, a reference sign 21 shows the fusible link unit according to the embodiment of the invention. The fusible link unit 21 is connected to a battery post 24 in a battery 23 of an automobile or the like via a battery terminal 22, and the fusible link unit 21 is formed so that a large current from the battery 23 can be supplied to loads which are not shown in the figure. The fusible link unit 21 has a portion which is connected to the battery terminal 22, and a portion which is connected to the above-mentioned loads. The fusible link unit 21 has a portion which, when an over-current flows, generates heat itself and melts so that a circuit is cut off.

When the fusible link unit 21 is assembled to the battery 23, the back surface 25 of the fusible link unit 21 faces the side surface 26 of the battery 23, and the front surface 27 of the fusible link unit 21 which is opposite to the back surface 25 faces the outside.

Below, the fusible link unit 21 is explained. The function of the fusible link unit 21 is the same as the conventional one, and the detailed explanation of the function is omitted.

Figure 4:
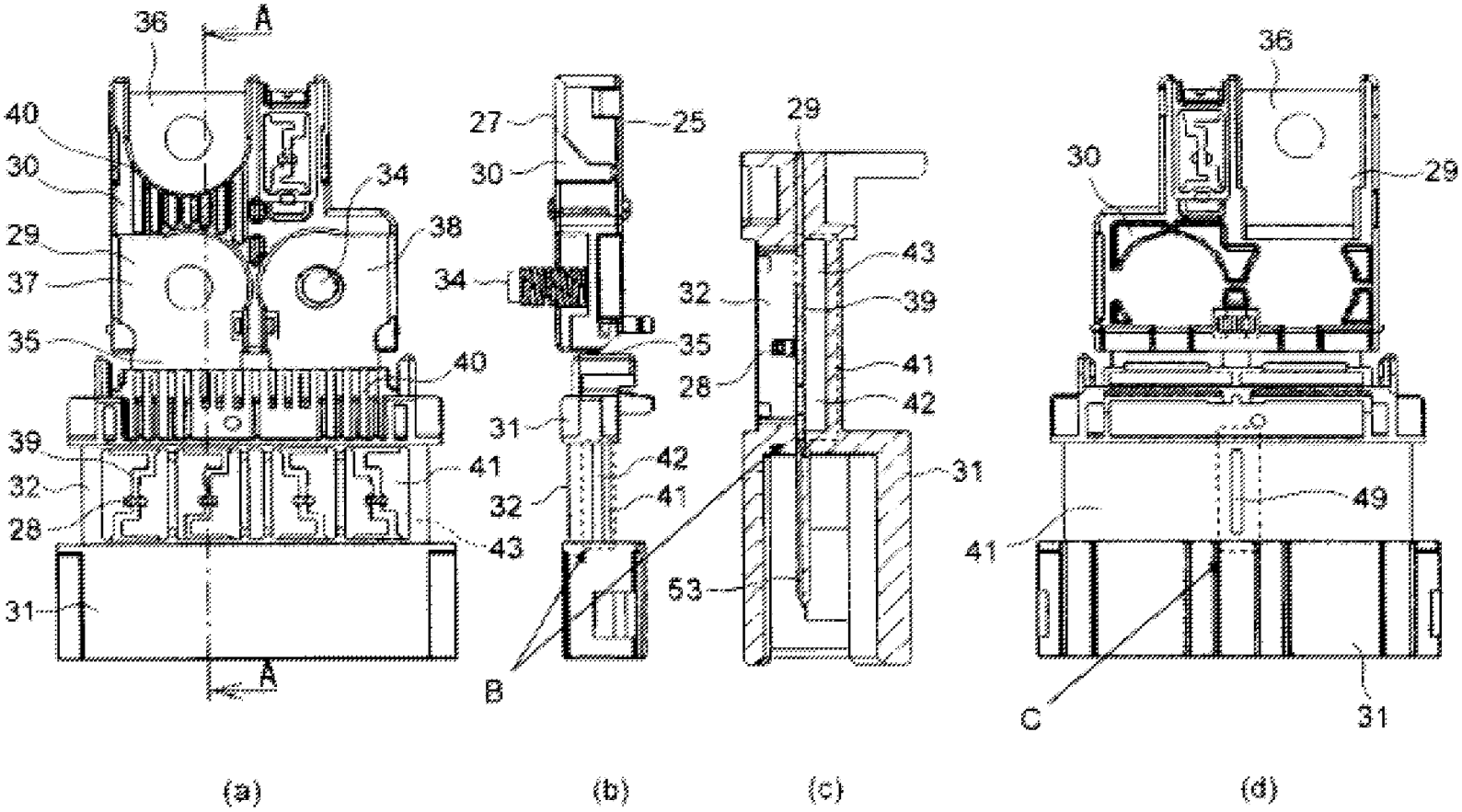
FIG. 4 is a figure which shows a state before the fusible link unit shown in FIG. 1 is bent, in which FIG. 4(*a*) is a top view, FIG. 4(*b*) is a front view, FIG. 4(*c*) is an A-A line sectional view of FIG. 4(*a*) and FIG. 4(*d*) is a bottom view.

In FIGS. 1 to 4(*d*), the fusible link unit 21 includes a conductive busbar 29 which contains fusible parts 28 (refer to FIGS. 3 to 4(*d*)), resin housings 30 and 31 which are integrally formed at predetermined positions of the busbar 29, a transparent resin cover 33 which is fastened and covering an exposure window 32 of the resin housing 31 which is formed so that the fusible parts 28 are observed through the transparent resin cover 33, and a bolt 34 which is provided to be projected from a predetermined position of the busbar 29.

Before the fusible link unit 21 is assembled to the battery 23, the fusible link unit 21 has a planar shape, as shown in FIGS. 4(*a*) to 4(*d*). When the fusible link unit 21 is bended to a L shape at the position of a hinge 35 which is described later, it becomes possible to assemble the fusible link unit 21 to the battery 23.

The busbar 29 is manufactured by punching a flat metal plate which is conductive to a predetermined shape by means of press processes (the illustration of the punched shape is omitted). At one side, the busbar 29 has a battery terminal connecting part 36, a first terminal connecting part 37, and a second terminal connecting part 38. At the other side, the busbar 29 has a plurality of tab terminals 53 (refer to FIG. 4(*c*)) which become portions that are connected to loads which are not shown in the figures.

The battery terminal connecting part 36 is formed as a portion which is connected to the battery terminal 22. The first terminal connecting part 37 and the second terminal connecting part 38 are formed as portions which are connected to terminal metal fittings that are provided at the terminals of cotton electric wires which are not shown in the figures. In this embodiment, the bolt 34, which is used to be connected to and fixed to the above metal fitting by being inserted into the above terminal metal fitting, is provided at the position of the second terminal connecting part 38.

The hinge 35 is formed in the middle of the busbar 29. The hinge 35 is formed as a portion which is bendable in the thickness direction at this position. Since the fusible link unit 21 has the hinge 35, it is possible to bend the fusible link unit 21 to substantially a shape. A plurality of narrow parts 39, each of the plurality of narrow parts having a bent portion, are provided between the hinge 35 and the plurality of tab terminals 53 which are not shown in the figure.

The narrow parts 39 are provided to correspond to the plurality of tab terminals 53, respectively. The fusible part 28 is fixed to the middle of the narrow part 39 by means of a swage. The fusible part 28 is a chip which is made of alloy such as tin or lead, and if an over-current flows, the fusible part 28 generates heat and melts.

The resin housings 30 and 31 are resin bodies formed via insertion molding to the busbar 29 by using a resin material which is insulative and heat resistant, and thus formed to shapes shown in the figures. The resin housing 30 is formed so that the battery terminal connecting part 36, the first terminal connecting part 37, and the second terminal connecting part 38 in the busbar 29 are partitioned, and the resin housing 31 is formed so that there are the exposure window 32 and the portions connected to the loads which are not shown in the figures. A plurality of fins 40 for heat dissipation are formed in the resin housings 30 and 31. The hinge 35 is exposed between the resin housings 30 and 31.

The exposure window 32 is formed so that the narrow parts 39 and the fusible parts 28 can be observed from the front surface side of the fusible link unit 21. The exposure window 32 is formed so that a space is produced around the narrow parts 39 and the fusible parts 28. The exposure window 32 is formed to have a rectangular empty chamber-like shape. A wall 41 is integrally provided at the back position of the exposure window 32. The wall 41 is a part of the resin housing 31, and is disposed at the back position of the fusible link unit 21. The wall 41 is formed with such a thickness that even if the fusible part 28 generates heat itself, melts, and reaches the side surface 26 of the battery 23, the wall 41 is not affected.

Slits 42 are formed at the two sides of the exposure window 32 and the wall 41 (two sides of the resin housing 31), respectively. The slits 42 are die cutting holes which are produced when the wall 41 is formed, and are formed so that the space between the narrow parts 39 and the fusible parts 28, and the wall 41 is kept. The slits 42 are formed to have an elongated shape from top to bottom. Opening parts at the two side positions of the slits 42 function as lock parts 43 which are engaged with lock projections 52 which are described later. The slits 42 are formed to have shapes that correspond to the shape of a slide mold 45 in a resin forming metal mold 44 which is shown in FIG. 5(*a*).

Herein, the resin forming metal mold 44 is described with reference to FIG. 5(*a*) to FIG. 6. The resin forming metal mold 44 has the slide mold 45 as described above and overlapping upper mold 46 and lower mold 47, and further has a slide mold pressing pin 48 for pressing the slide mold 45 to the lower mold 47. Since there is the slide mold pressing pin 48, a slide mold pressing hole 49 (refer to FIG. 4(*d*)) is formed in the wall 41 (refer to FIGS. 4(*a*) to 4(*d*)) in the resin housing 31. The portion produced with the slide mold 45 and the portion produced with the slide mold pressing pin 48 are the portions of B and C enclosed with the dashed lines in FIGS. 4(*b*) to 4(*d*).

In FIG. 3, the resin cover 33 is formed by using resin material which is insulative, transparent and heat resistant.

The resin cover 33 has a rough board-shaped cover body 50, and arms 51 which are connected to positions at the right and the left sides of the cover body 50.

The cover body 50 is formed as a portion which covers the exposure window 32. The rough nail-shaped lock projections 52 are formed at the arms 51. The lock projections 52 are formed as portions which are hooked to the lock parts 43 which are formed by the opening parts of the slits 42. The lock projections 52 enter into the lock parts 43 so that the slits 42 can be covered.

The arm part 51 is formed so that when the exposure window 32 is covered by the resin cover 33, the lock projections 52 can climb over the edges of the slits 42 while being bent outwards. When the lock projections 52 are hooked to the lock parts 43 of the slits 42, the resin cover 33 will be fastened to the exposure window 32, and the resin cover 33 will be fitted to the exposure window 32.

Since the resin cover 33 is fastened at two places, or positions of two sides, the resin cover is tightly fitted. Even if the fusible parts 28 melt, the cover is not likely to disengage from the fusible link unit 21. Thus, since the disengagement of the cover does not occur, the melt pieces will not scatter out of the fusible link unit 21.

As explained by referring to FIGS. 1 to 6 above, the fusible link unit 21 of the invention is integrally provided with a wall 41 at the side where it is not necessary to visually recognize the fusible parts 28 when the fusible link unit 21 is assembled to the battery 23 (the back position of the exposure window 32 of the resin housing 31), and has such a structure that the resin cover 33 is not fitted. Therefore, compared with the conventional example, it is possible to reduce the number of components, to simplify the structure, and to reduce the cost.

Even if the fusible link unit 21 of the invention does not separately provide a portion which is fitted and fastened to the resin cover 33 in the resin housing 31, the lock parts 43 which are openings of the slits 42 produced when the wall 41 is formed can be used. Therefore, the structure can be simplified, and the resin cover 33 can be fastened.

Since the fusible link unit 21 of the invention has such a structure that the slits 42 are covered by the lock projections 52 of the resin cover 33, the dust proof performance and water proof performance of the fusible link unit 21 can be ensured.

Although the present invention is described in detail with reference to specific embodiments, it is apparent that various modifications and amendments may be made by those skilled in the art without departing from the spirit and scope of the invention.

INDUSTRIAL APPLICABILITY

According to the fusible link unit of the invention, since there is the wall at the back position of the exposure window which is formed to face the fusible parts, it is not necessary to cover the side of the wall with a resin cover, and as a result, an effect is achieved resulting in the number of used resin covers is lower by one (1) than before. Further, according to the invention, with the reduction of the number of the resin covers, the manufacturing cost can be reduced. Furthermore, the manufacturing cost can be reduced.

REFERENCE SIGNS LIST

21 fusible link unit
22 battery terminal
23 battery
24 battery post
25 back surface
26 side surface
27 front surface
28 fusible part
29 busbar
30, 31 resin housing
32 exposure window
33 resin cover
34 bolt
35 hinge
36 battery terminal connecting part
37 first terminal connecting part
38 second terminal connecting part
39 narrow part
40 fin
41 wall
42 slit
43 lock part
44 resin forming metal mold
45 slide mold
46 upper mold
47 lower mold
48 slide mold pressing pin
49 slide mold pressing hole
50 cover body
51 arm
52 lock projection

The invention claimed is:

1. A fusible link unit comprising:

a conductive busbar comprising a fusible part;

a first resin housing and a second resin housing, each of the resin housings integrally formed at predetermined positions along the busbar; and a transparent cover, wherein the first resin housing comprises:

an exposure window inside which the fusible part is provided; and a non-transparent wall provided at a back position of the exposure window, the first resin housing being formed as a one piece structure including the non-transparent wall and the non-transparent wall facing the fusible part, wherein the exposure window and the non-transparent wall define slits at both sides of the first resin housing such that the slits extend through the first resin housing, wherein the transparent resin cover covers at least a front position opposite to the back position of the exposure window, the fusible part provided between the front and back positions and housed in the exposure window being observable through the transparent resin cover, and wherein a length of the non-transparent wall in a direction perpendicular to the slits extending through the first resin housing and a length of each slit in the direction are substantially equal.

2. The fusible link unit according to claim 1, wherein the transparent resin cover comprises:

a cover body; and lock projections protruding from opposite sides of the cover body of the resin cover, and wherein the lock projections are inserted into the slits.

* * * * *